US009794717B2

(12) United States Patent
Araki

(10) Patent No.: US 9,794,717 B2
(45) Date of Patent: Oct. 17, 2017

(54) AUDIO SIGNAL PROCESSING APPARATUS AND AUDIO SIGNAL PROCESSING METHOD

(71) Applicant: Panasonic Intellectual Property Management Co., Ltd., Osaka (JP)

(72) Inventor: Junji Araki, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/969,324

(22) Filed: Dec. 15, 2015

(65) Prior Publication Data

US 2016/0100270 A1 Apr. 7, 2016

Related U.S. Application Data

(63) Continuation of application No. PCT/JP2014/003105, filed on Jun. 11, 2014.

(30) Foreign Application Priority Data

Jun. 20, 2013 (JP) ..... 2013-129159

(51) Int. Cl.
*H04R 5/02* (2006.01)
*H04S 7/00* (2006.01)
(Continued)

(52) U.S. Cl.
CPC ..... *H04S 7/30* (2013.01); *H04S 1/007* (2013.01); *H04S 5/005* (2013.01); *H04S 7/00* (2013.01);
(Continued)

(58) Field of Classification Search
CPC . H04S 5/005; H04S 7/30; H04S 1/007; H04S 7/305; H04S 2420/01; H04S 2400/01
(Continued)

(56) References Cited

U.S. PATENT DOCUMENTS

| | | | | |
|---|---|---|---|---|
| 5,742,688 | A | 4/1998 | Ogawa et al. | |
| 6,178,247 | B1 | 1/2001 | Ogita | |
| 7,602,921 | B2 | 10/2009 | Iida et al. | |
| 2004/0013271 | A1 * | 1/2004 | Moorthy | H04S 1/002 381/1 |

(Continued)

FOREIGN PATENT DOCUMENTS

| | | |
|---|---|---|
| JP | 7-203595 | 8/1995 |
| JP | 7-222297 | 8/1995 |

(Continued)

OTHER PUBLICATIONS

International Search Report dated Jul. 29, 2014 in corresponding International Application No. PCT/JP2014/003105.

*Primary Examiner* — Vivian Chin
*Assistant Examiner* — Con P Tran
(74) *Attorney, Agent, or Firm* — Wenderoth, Lind & Ponack, L.L.P.

(57) ABSTRACT

An audio signal processing apparatus includes: an obtaining unit which obtains a stereo signal including an R signal and an L signal; a control unit which generates a processed R signal and a processed L signal by performing (i) a first process of convolving pairs of right- and left-ear head related transfer functions into the R signal so that a sound image of the R signal is localized at each of two or more different positions at a right side of a listener; and (ii) a second process of convolving pairs of right- and left-ear head related transfer functions into the L signal so that a sound image of the L signal is localized at each of two or more different positions at a left side of the listener; and an output unit which outputs the processed R signal and the processed L signal.

6 Claims, 11 Drawing Sheets

(51) Int. Cl.
*H04S 5/00* (2006.01)
*H04S 1/00* (2006.01)

(52) U.S. Cl.
CPC ..... *H04S 7/305* (2013.01); *H04S 2400/01* (2013.01); *H04S 2420/01* (2013.01)

(58) Field of Classification Search
USPC ..... 381/303, 310, 309, 307, 300, 61, 62, 63; 708/5, 315, 420
See application file for complete search history.

(56) References Cited

U.S. PATENT DOCUMENTS

| | | | | |
|---|---|---|---|---|
| 2004/0196991 | A1 | 10/2004 | Iida et al. | |
| 2008/0219454 | A1 | 9/2008 | Iida et al. | |
| 2009/0046864 | A1* | 2/2009 | Mahabub | H04S 7/30 381/17 |
| 2010/0322428 | A1* | 12/2010 | Fukui | H04S 7/30 381/17 |
| 2013/0343550 | A1 | 12/2013 | Araki | |

FOREIGN PATENT DOCUMENTS

| | | |
|---|---|---|
| JP | 9-37399 | 2/1997 |
| JP | 10-200999 | 7/1998 |
| JP | 2003-102099 | 4/2003 |
| JP | 2004-102099 | 4/2004 |
| JP | 2005-51801 | 2/2005 |
| JP | 2008-211834 | 9/2008 |
| JP | 2009-105565 | 5/2009 |
| WO | 2012/144227 | 10/2012 |

* cited by examiner

AUDIO SIGNAL PROCESSING APPARATUS AND AUDIO SIGNAL PROCESSING METHOD

CROSS REFERENCE TO RELATED APPLICATIONS

This is a continuation application of PCT International Application No. PCT/JP2014/003105 filed on Jun. 11, 2014, designating the United States of America, which is based on and claims priority of Japanese Patent Application No. 2013-129159 filed on Jun. 20, 2013. The entire disclosures of the above-identified applications, including the specifications, drawings and claims are incorporated herein by reference in their entirety.

FIELD

The present disclosure relates to an audio signal processing apparatus and an audio signal processing method for performing signal processing on a stereo signal including an R signal and an L signal.

BACKGROUND

There is a system for playing back a sound from a sound source for playing back a virtual sound image, using a speaker disposed near ears of a listener. Patent Literature 1 (PTL 1) discloses a method for enhancing surround effects by a virtual sound image by adding reverb components to filter characteristics.

CITATION LIST

Patent Literature

[PTL 1]
Japanese Unexamined Patent Application Publication No. H7-222297

SUMMARY

There is much room for consideration regarding methods for enhancing surround effects by localizing a virtual sound image using two speakers.

The present disclosure provides an audio signal processing apparatus and an audio signal processing method for allowing obtainment of higher surround effects by virtual sound images.

An audio signal processing apparatus according to the present disclosure includes: an obtaining unit configured to obtain a stereo signal including an R signal and an L signal; a control unit configured to generate a processed R signal and a processed L signal by performing (i) a first process of convolving two or more pairs of head related transfer functions which are a right-ear head related transfer function and a left-ear head related transfer function into the R signal so that a sound image of the R signal is localized at each of two or more different positions at a right side of a listener; and (ii) a second process of convolving two or more pairs of head related transfer functions which are a right-ear head related transfer function and a left-ear head related transfer function into the L signal so that a sound image of the L signal is localized at each of two or more different positions at a left side of the listener; and an output unit configured to output the processed R signal and the processed L signal.

The audio signal processing apparatus disclosed herein is capable of providing higher surround effects by virtual sound images.

BRIEF DESCRIPTION OF DRAWINGS

These and other objects, advantages and features of the present disclosure will become apparent from the following description thereof taken in conjunction with the accompanying drawings that illustrate a specific embodiment of the present disclosure.

DESCRIPTION OF EMBODIMENTS

Figure 1:
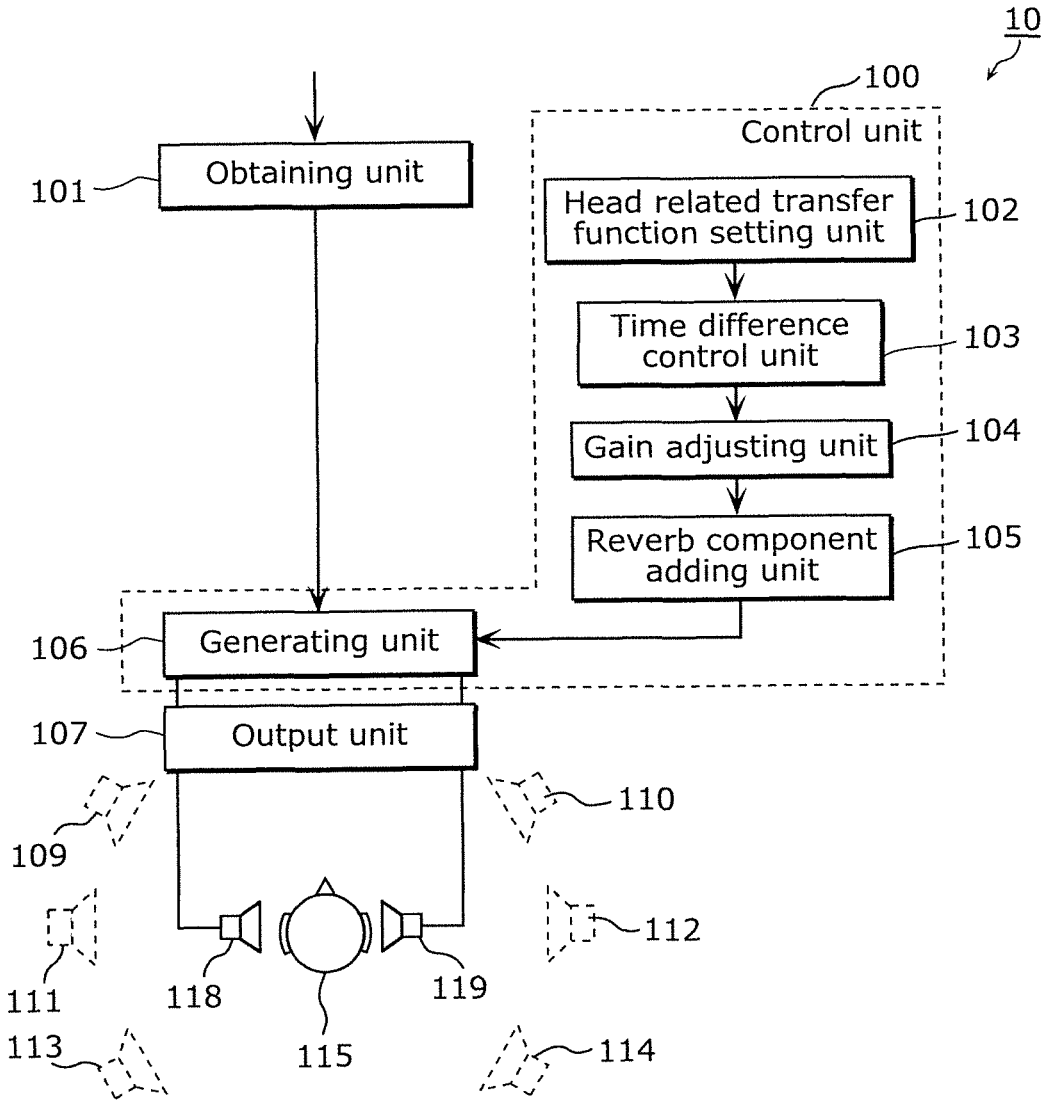
FIG. 1 is a block diagram illustrating an overall configuration of an audio signal processing apparatus according to Embodiment 1.

Hereinafter, embodiments are described in detail referring to the drawings as necessary. It should be noted that unnecessarily detailed explanation may not be provided. For example, well-known matters may not be explained in detail, and substantially the same constituent elements may not be repeatedly explained. Such explanation is omitted to prevent the following explanation from being unnecessarily redundant, thereby facilitating the understanding of a person skilled in the art.

The inventor provides the attached drawings and following explanation to allow the person skilled in the art to fully appreciate the present disclosure, and thus the attached drawings and following explanation should not be interpreted as limiting the scope of the claims.

Embodiment 1

[Overall Configuration]

Hereinafter, Embodiment 1 is described with reference to the drawings.

First, an overall configuration of an audio signal processing apparatus according to Embodiment 1 is described. FIG. 1 is a block diagram illustrating the overall configuration of the audio signal processing apparatus 10 according to Embodiment 1.

The audio signal processing apparatus 10 illustrated in FIG. 1 includes an obtaining unit 101, a control unit 100, and an output unit 107. The control unit 100 includes: a head related transfer function setting unit 102; a time difference control unit 103; a gain adjusting unit 104; a reverb component adding unit 105; and a generating unit 106.

In the configuration illustrated in FIG. 1, a signal output from the output unit 107 is played back from a near-ear L speaker 118 and a near-ear R speaker 119. The listener 115 listens to a sound played back from the near-ear L speaker 118 and the near-ear R speaker 119.

Here, the listener 115 perceives a sound played back from the near-ear L speaker 118 as if the sound was played back from a virtual front L speaker 109, a virtual side L speaker 111, and a virtual back L speaker 113. The listener 115 perceives a sound played back from the near-ear R speaker 119 as if the sound was played back from a virtual front R speaker 110, a virtual side R speaker 112, and a virtual back R speaker 114.

These effects can be obtained by means of two or more pairs (three pairs in Embodiment 1) of head related transfer functions being convolved into obtained L signals and R signals in the audio signal processing apparatus 10. This point is a feature of the audio signal processing apparatus 10. Hereinafter, constituent elements of the audio signal processing apparatus 10 are described. It is to be noted that a pair of head related transfer functions means a pair of a right-ear head related transfer function and a left-ear head related transfer function.

The obtaining unit 101 obtains a stereo signal including an R signal and an L signal. For example, the obtaining unit 101 obtains the stereo signal stored in a server on a network. More specifically, the obtaining unit 101 obtains the stereo signal from, for example, a storage (not illustrated in the drawings, the storage is an HDD, an SSD, or the like) in the audio signal processing apparatus 10, or a recording medium (an optical disc such as a DVD, a USB memory, or the like) which is inserted into the audio signal processing apparatus 10. Stated differently, the obtaining unit 101 may obtain the stereo signal through any route that is inside or outside of the audio signal processing apparatus 10, or any other route through which the obtaining unit 101 can obtain a stereo signal.

The head related transfer function setting unit 102 of the control unit 100 sets head related transfer functions to be convolved into the R signal and the L signal obtained by the obtaining unit 101.

More specifically, the head related transfer function setting unit 102 sets two or more pairs of head related transfer functions for the R signal so that the R signal is localized at two or more different positions at the right side of the listener 115. Here, in Embodiment 1, "the two or more different positions at the right side of the listener 115" are three positions of a position of a virtual front R speaker 110, a position of a virtual side R speaker 112, and a position of a virtual back R speaker 114.

The head related transfer function setting unit 102 generates a pair of head related transfer functions by grouping the two or more pairs of head related transfer functions that have been set for the R signal.

The head related transfer function setting unit 102 sets two or more pairs of head related transfer functions for the L signal so that the L signal is localized at each of two or more different positions at the left side of the listener 115. Here, in Embodiment 1, "the two or more different positions at the left side of the listener 115" are three positions of a position of a virtual front L speaker 109, a position of a virtual side L speaker 111, and a position of a virtual back L speaker 113.

The head related transfer function setting unit 102 generates a pair of head related transfer functions by grouping the two or more pairs of head related transfer functions that have been set for the L signal.

Next, the generating unit 106 convolves the pair of head related transfer functions grouped by the head related transfer function setting unit 102 into the R signal and the L signal obtained by the obtaining unit 101. It is to be noted that the generating unit 106 may convolve the two or more pairs of head related transfer functions before being grouped, separately into the R signal and the L signal.

Next, the output unit 107 outputs the processed L signal newly generated by convolving the head related transfer functions to the near-ear L speaker 118, and the processed R signal newly generated by convolving the head related transfer functions to the near-ear R speaker 119.

Figure 2A:
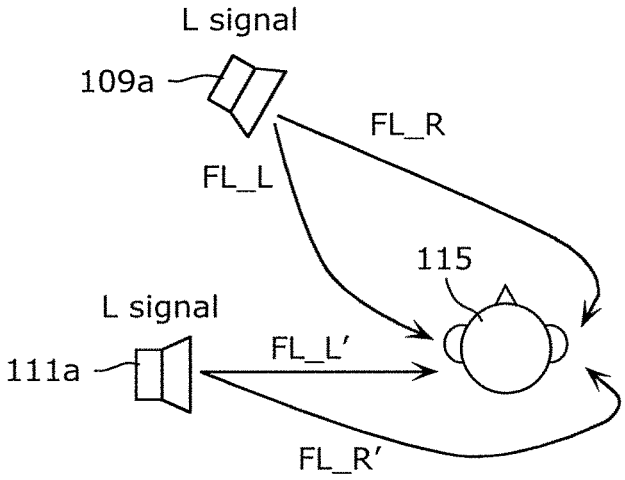
FIG. 2A is a first diagram for illustrating convolution of two or more pairs of head related transfer functions.
Figure 2B:
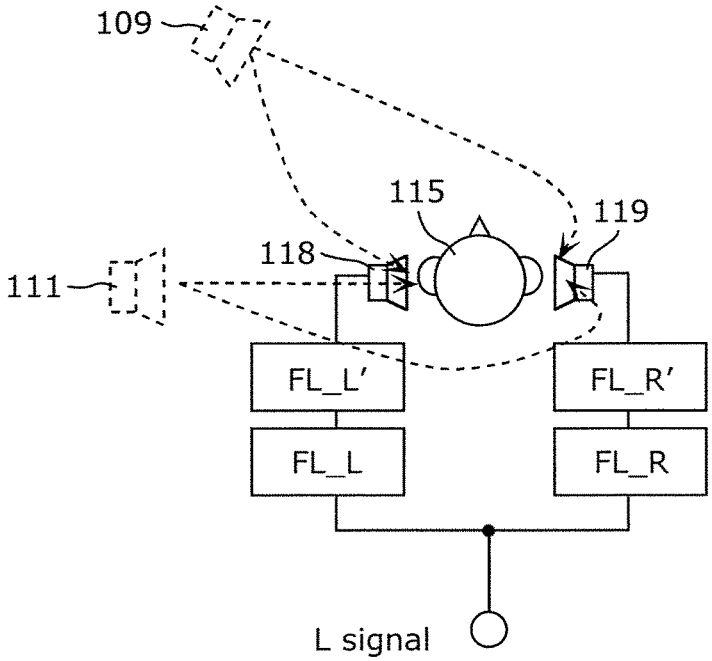
FIG. 2B is a second diagram for illustrating convolution of two or more pairs of head related transfer functions.

Here, convolution of the two or more pairs of head related transfer functions is described. Each of FIG. 2A and FIG. 2B is a diagram for illustrating convolution of the two or more pairs of head related transfer functions. Each of FIG. 2A and FIG. 2B illustrates an example where two pairs of head related transfer functions are convolved into the L signal, and a sound image of the L signal is localized at each of two different positions at the left side of the listener 115.

As illustrated in FIG. 2A, each pair of head related transfer functions in the case where a sound of the L signal is played back from a front L speaker 109*a* includes a left-ear head related transfer function and a right-ear head related transfer function. More specifically, the pair of head related transfer functions includes a head related transfer function FL_L (left-ear head related transfer function) from the front L speaker 109*a* to the left ear of the listener 115 and a head related transfer function FL_R (right-ear head related transfer function) from the front L speaker 109*a* to the right ear of the listener 115.

On the other hand, each pair of head related transfer functions in the case where a sound of the L signal is played back from a side L speaker 111*a* includes a left-ear head related transfer function and a right-ear head related transfer function. More specifically, the pair of head related transfer functions includes a head related transfer function FL_L' from the side L speaker 111*a* to the left ear of the listener 115 and a head related transfer function FL_R' from the side L speaker 111*a* to the right ear of the listener 115.

In the case where a sound field as illustrated in FIG. 2A is reproduced using two speakers which are the near-ear L speaker 118 and the near-ear R speaker 119, these four head related transfer functions are convolved into the L signal.

Next, as illustrated in FIG. 2B, a signal obtained by convolving the left-ear head related transfer function FL_L and the left-ear head related transfer function FL_L' into the L signal is generated as a processed L signal, and the processed L signal is output to the near-ear L speaker 118, and likewise, a signal obtained by convolving the right-ear head related transfer function FL_R and the right-ear head related transfer function FL_R' into the L signal is generated as a processed R signal, and the processed R signal is output to the near-ear R speaker 119.

The listener 115 listening to the sounds of the processed L and R signals through the near-ear L speaker 118 and the near-ear R speaker 119 perceives the sound images of the L signals as if they are localized at the positions of the virtual front L speaker 109 and the virtual side L speaker 111.

As described above, the processed L signal may be generated by convolving, into the L signal, the head related transfer function obtained by synthesizing (grouping) the left-ear head related transfer function FL_L and the left-ear head related transfer function FL_L'. Likewise, the processed R signal may be generated by convolving, into the R signal, the head related transfer function (synthesized head related transfer function) obtained by synthesizing the left-ear head related transfer function FL_R and the left-ear head related transfer function FL_R'. Stated differently, the definition that "two pairs of head related transfer functions are convolved" covers that a pair of synthesized head related transfer functions obtained by synthesizing two pairs of head related transfer functions is convolved.

FIG. 2B illustrates an example where the head related transfer functions are convolved into the L signal. The same is true of a case where two pairs of head related transfer functions are convolved into an R signal, and the sound image of the R signal is localized at each of two different positions at the right side of the listener 115.

In the case of localizing the sound image at both of the right and left sides of the listener 115 as illustrated in FIG. 1, the processed L signal is a signal obtained by synthesizing (i) a signal obtained by convolving, into the L signal, three left-ear head related transfer functions (from the virtual front L speaker 109, the virtual side L speaker 111, and the virtual back L speaker 113 to the left ear of the listener 115) and (ii) a signal obtained by convolving, into the R signal, three left-ear head related transfer functions (from the virtual front R speaker 110, the virtual side R speaker 112, and the virtual back R speaker 114 to the left ear of the listener 115). This is true of the processed R signal.

[Operations]

Figure 3:
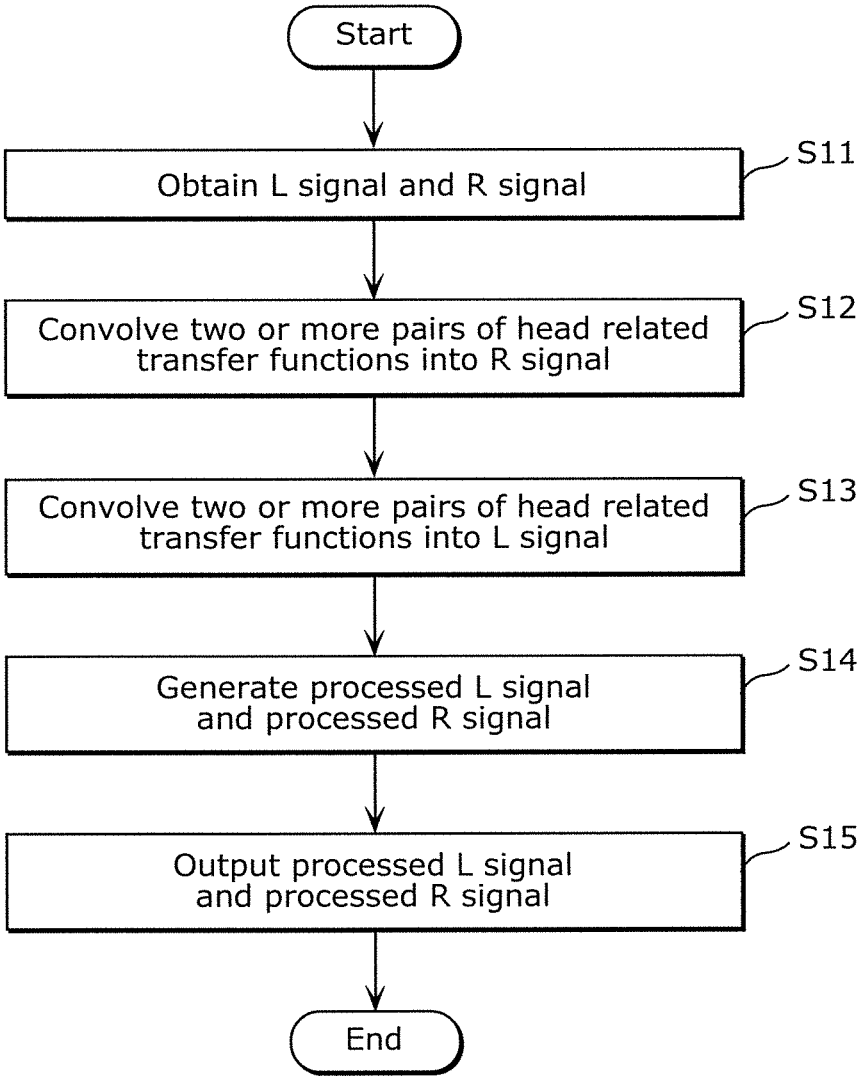
FIG. 3 is a flowchart of operations performed by the audio signal processing apparatus according to Embodiment 1.

Next, the above-described operations performed by the audio signal processing unit 10 are described with reference to a flowchart. FIG. 3 is a flowchart of operations performed by the audio signal processing apparatus 10.

First, the obtaining unit 101 obtains an L signal and an R signal (S11). Next, the control unit 100 convolves two or more pairs of head related transfer functions into the obtained R signal (S12). More specifically, the control unit 100 performs a convolution process on the two or more pairs of head related transfer functions so that the sound image of the R signal is localized at each of two different positions at the right side of the listener 115.

Likewise, the control unit 100 convolves two or more pairs of head related transfer functions into the obtained L signal (S13). More specifically, the control unit 100 performs a convolution process on the two or more pairs of head related transfer functions so that the sound image of the L signal is localized at each of two different positions at the left side of the listener 115. The control unit 100 generates the processed L signal and the processed R signal through these processes (S14).

Lastly, the output unit 107 outputs the processed L signal generated to the near-ear L speaker 118, and outputs the processed R signal generated to the near-ear R speaker 119 (S15).

In this way, the audio signal processing apparatus 10 (the control unit 100) convolves a plurality of pairs of head related transfer functions into the single channel signal (the L signal or the R signal). By doing so, even in the case where the listener 115 listens to the sound using a headphone, the listener 115 perceives the sound as if the sound is generated outside his or her head, thereby enjoying high surround effects.

[Operations for Adjusting Head Related Transfer Functions]

Figure 4:
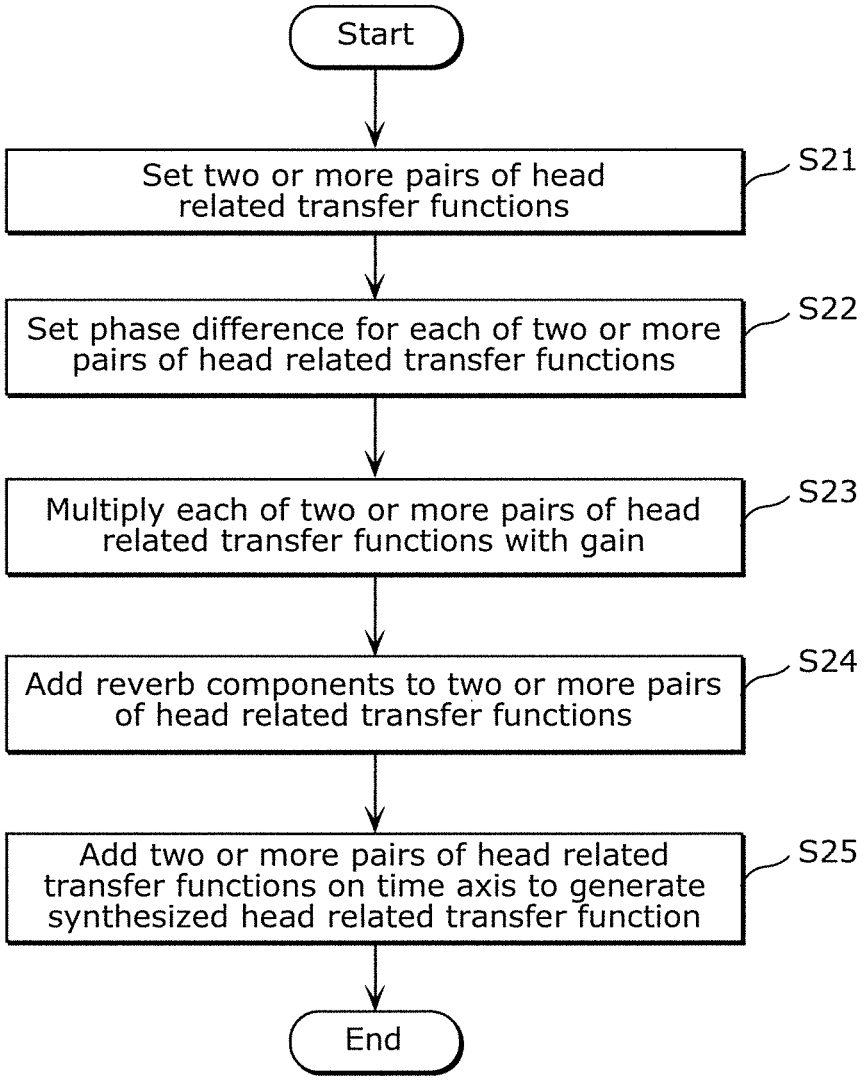
FIG. 4 is a flowchart of operations performed by a control unit to adjust two or more pairs of head related transfer functions.

In Embodiment 1, the control unit 100 performs three processes on respective pairs of head related transfer functions to be convolved into the R signal, specifically, a process of adding different reverb components to the pairs, a process of setting phase differences to the respective pairs, and a process of multiplying the respective pairs with different gains. Next, the respective pairs of head related transfer functions through the three processes are convolved into the R signal. Likewise, the control unit 100 performs three processes on respective pairs of head related transfer functions to be convolved into the L signal, specifically, a process of adding different reverb components to the pairs, a process of setting phase differences to the respective pairs, and a process of multiplying the respective pairs with different gains. Hereinafter, operations performed by the control unit 100 to adjust the head related transfer functions are described. FIG. 4 is a flowchart of operations performed by the control unit 100 to adjust two or more pairs of head related transfer functions.

As illustrated in FIG. 1, the control unit 100 includes: the head related transfer function setting unit 102; the time difference control unit 103; the gain adjusting unit 104; and the reverb component adding unit 105.

The head related transfer function setting unit 102 sets head related transfer functions to be convolved into the R signal and the L signal included in a stereo signal (2 ch signal) obtained by the head related transfer function setting unit 102 (S21). The head related transfer function setting unit 102 sets two or more (two kinds of) head related transfer functions for each of the R signal and the L signal. The head related transfer function setting unit 102 outputs the set two or more head related transfer functions to the time difference control unit 103.

Here, the two or more head related transfer functions set for each of the R signal and the L signal are arbitrarily determined by a designer. The pair of head related transfer functions set for the R signal and the pair of head related transfer functions set for the L signal do not need to have right-left symmetric characteristics. It is only necessary that two or more different kinds of head related transfer functions be set for each of the R signal and the L signal.

The head related transfer functions have been measured or designed in advance and have been recorded as data in a storage unit (not illustrated) such as a memory.

Next, the time difference control unit 103 sets different phases for the head related transfer functions for the R signal, and different phases for the head related transfer functions for the L signal. In other words, the time difference control unit 103 sets a phase difference for each pair of head related transfer functions to be convolved into the R signal, and a phase difference for each pair of head related transfer functions to be convolved into the L signal (S22). Next, the time difference control unit 103 outputs the pair of head related transfer functions having the adjusted phase to the gain adjusting unit 104.

By doing so, the two or more pairs of head related transfer functions to be convolved into the R signal have different phases, and the two or more pairs of head related transfer functions to be convolved into the L signal have different phases.

In this way, the time difference control unit 103 controls time until a virtual sound (virtual sound image) reaches the listener 115. For example, it is possible to cause the listener 115 to perceive the processed L signal as if a virtual sound from the virtual side L speaker 111 reaches earlier than a virtual sound from the virtual front L speaker 109.

The phase difference set by the time difference control unit 103 depends on the sound field that the designer wishes to reproduce using the processed R signal and the processed L signal. For example, the time difference control unit 103 sets, based on an interaural time difference, the phases to be set to the head related transfer functions (pairs of head related transfer functions) to be convolved into each of the R signal and the L signal output from the head related transfer function setting unit 102.

More specifically, the time difference control unit 103 sets a phase difference such that the R signal newly generated by convolving the head related transfer functions having an interaural time difference that is a first time difference (of 1 ms for example) is listened to by the listener 115 earlier than the R signal newly generated by convolving the head related transfer functions having an interaural time difference that is a second time difference (of 0 ms for example) smaller than the first time difference. Stated differently, the time difference control unit 103 sets the phase difference to each pair of two or more pairs of head related transfer functions to be convolved into the R signal such that the phase of a latter head related transfer function of the pair is delayed more significantly as the interaural time difference of the pair becomes smaller.

Meanwhile, the time difference control unit 103 sets a phase difference such that the L signal newly generated by convolving the head related transfer functions having an interaural time difference that is a third time difference (of 1 ms for example) is listened to by the listener 115 earlier than the L signal newly generated by convolving the head related transfer functions having an interaural time difference that is a fourth time difference (of 0 ms for example) smaller than the third time difference. Stated differently, the time difference control unit 103 sets the phase difference to each pair of head related transfer functions to be convolved into the L signal such that the phase of a latter head related transfer function of the pair is delayed more significantly as the interaural time difference becomes smaller.

Next, the gain adjusting unit 104 sets a gain to be multiplied on each of two or more pairs of head related transfer functions to be convolved into the R signal to be output from the time difference control unit 103. Next, the gain adjusting unit 104 sets a gain to be multiplied on each of two or more pairs of head related transfer functions to be convolved into the L signal to be output from the time difference control unit 103. The gain adjusting unit 104 multiples a corresponding one of the pairs of head related transfer functions with the gain, and outputs the result to the reverb component adding unit 105. More specifically, the gain adjusting unit 104 multiplies the pairs of head related transfer functions to be convolved into the R signal with different gains, and the pairs of head related transfer functions to be convolved into the L signal with different gains (S23).

The gain set by the gain adjusting unit 104 depends on the sound field that the designer wishes to reproduce using the processed R signal and the processed L signal. For example, the gain adjusting unit 104 sets, based on the interaural time difference, the gain multiplied on the head related transfer functions (each pair of head related transfer functions) to be convolved into the R signal, and the gain multiplied on the head related transfer functions (each pair of head related transfer functions) to be convolved into the L signal.

More specifically, the gain adjusting unit 104 sets the gain such that the R signal newly generated by convolving the head related transfer functions having the interaural time difference that is the first time difference (of 1 ms for example) sounds louder to the listener 115 than the R signal newly generated by convolving the head related transfer functions having the interaural time difference that is the second time difference (of 0 ms for example) smaller than the first time difference. Stated differently, the gain adjusting unit 104 multiplies each pair of head related transfer functions to be convolved into the R signal by a larger gain as the interaural time difference is larger.

Furthermore, the gain adjusting unit 104 sets the gain such that the L signal newly generated by convolving the head related transfer functions having the interaural time difference that is the third time difference (of 1 ms for example) sounds louder to the listener 115 than the L signal newly generated by convolving the head related transfer functions having the interaural time difference that is the fourth time difference (of 0 ms for example) smaller than the third time difference. Stated differently, the gain adjusting unit 104 multiplies each pair of head related transfer functions to be convolved into the L signal by a larger gain as the interaural time difference is larger.

Next, the reverb component adding unit 105 sets reverb components to each of the head related transfer functions for the R signal output from the gain adjusting unit 104. Reverb components mean sound components representing reverb in different spaces such as a small space and a large space. Next, the reverb component adding unit 105 sets reverb components to each of the head related transfer functions for the L signal output from the gain adjusting unit 104. Next, the reverb component adding unit 105 outputs the head related transfer functions having the reverb components set (added) thereto to the generating unit 106. Stated differently, the reverb component adding unit 105 adds different reverb components to each pair of head related transfer functions to be convolved into the R signal, and adds different reverb components to each pair of head related transfer functions to be convolved into the L signal (S24).

The reverb components set by the reverb component adding unit 105 depend on the sound field that the designer wishes to reproduce using the processed R signal and the processed L signal.

For example, the reverb component adding unit 105 sets, based on the interaural time difference, the reverb components to be added to the head related transfer functions to be convolved into the R signal and the reverb components to be added to the head related transfer functions to be convolved into the L signal.

More specifically, the reverb component adding unit 105 adds the reverb components simulated in a first space to the head related transfer functions having the interaural time difference that is the first time difference (of 1 ms) among the two or more pairs of head related transfer functions to be convolved into the R signal. Next, the reverb component adding unit 105 adds reverb components simulated in a second space larger than the first space to the head related transfer functions having the interaural time difference that is the second time difference (of 0 ms for example) smaller than the first time difference. Stated differently, the reverb component adding unit 105 adds different reverb components to each pair of head related transfer functions to be convolved into the R signal.

Meanwhile, the reverb component adding unit 105 adds the reverb components simulated in a third space to the head related transfer functions having the interaural time difference that is the first time difference (of 1 ms) among the two or more pairs of head related transfer functions to be convolved into the L signal. Next, the reverb component adding unit 105 adds reverb components simulated in a fourth space larger than the third space to the head related transfer functions having the interaural time difference that is the fourth time difference (of 0 ms for example) smaller than the third time difference. Stated differently, the reverb component adding unit 105 adds different reverb components to each pair of head related transfer functions to be convolved into the L signal.

For example, the reverb component adding unit 105 sets three reverb components when three head related transfer functions are convolved into the R signal. Likewise, the reverb component adding unit 105 sets three reverb components when three head related transfer functions are convolved into the L signal. It is to be noted that two of the three reverb components may be the same when three reverb components are set.

Lastly, the control unit 100 adds the head related transfer functions to be convolved into the R signal on a time axis to generate a synthesized head related transfer function, and adds the head related transfer functions to be convolved into the L signal on a time axis to generate a synthesized head related transfer function (S25). The generated synthesized head related transfer functions are output to the generating unit 106. As described above, the head related transfer functions may be convolved without being synthesized.

Specific Examples where Head Related Transfer Functions are Adjusted

Hereinafter, specific examples where head related transfer functions are adjusted are explained. The following explanation is given defining that the position in front of the listener 115 is 0°, and the position along an axis passing through an ear of the listener 115 is 90°, and assuming that three pairs of head related transfer functions of 60°, 90°, and 120° are convolved into each of the R signal and the L signal. The interaural time differences described above are smallest in the head related transfer functions of 0°, and are largest in the head related transfer functions of 90°.

Here, the pair of head related transfer functions of 60° for the R signal is intended to localize the sound image of the R signal at the position of the virtual front R speaker 110 in FIG. 1, and the pair of head related transfer functions of 90° for the R signal is intended to localize the sound image of the R signal at the position of the virtual side R speaker 112 in FIG. 1. In addition, the pair of head related transfer functions of 120° for the R signal is intended to localize the sound image of the R signal at the position of the virtual back R speaker 114 in FIG. 1.

Likewise, the pair of head related transfer functions of 60° for the L signal is intended to localize the sound image of the L signal at the position of the virtual front R speaker 109 in FIG. 1, and the pair of head related transfer functions of 90° for the L signal is intended to localize the sound image of the L signal at the position of the virtual side L speaker 111 in FIG. 1. In addition, the pair of head related transfer functions of 120° for the L signal is intended to localize the sound image of the L signal at the position of the virtual back R speaker 113 in FIG. 1.

In the following explanation, it is assumed that the three pairs of head related transfer functions for the R signal have phases matching each other, and the three pairs of head related transfer functions for the L signal have phases matching each other.

Figure 5:
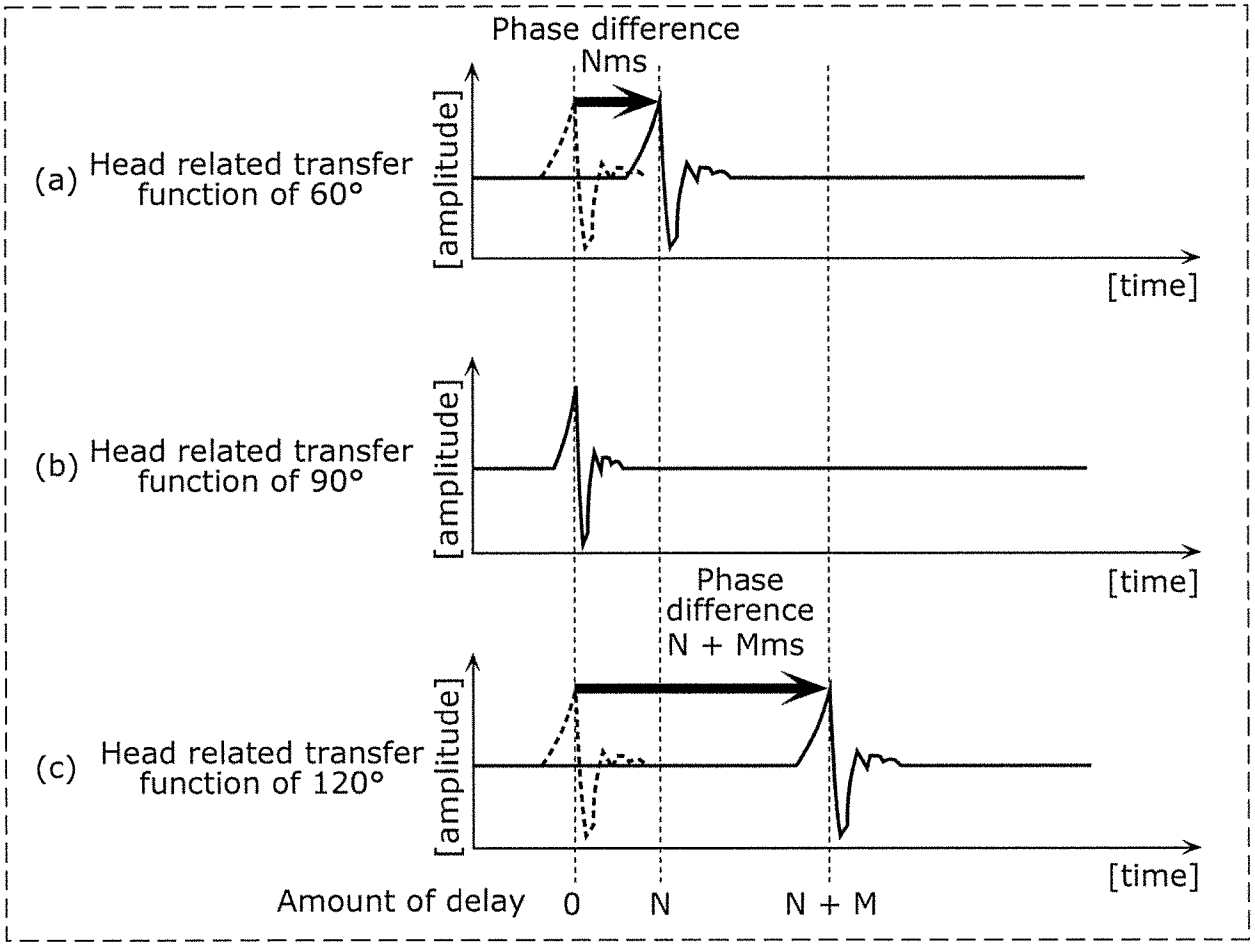
FIG. 5 is a diagram illustrating time waveforms of head related transfer functions for explaining methods for setting phase differences of the two or more pairs of head related transfer functions.

First, methods performed by the time difference control unit 103 to set the phase differences (phases) is explained. FIG. 5 is a diagram illustrating time waveforms of head related transfer functions for explaining methods for setting phase differences. In FIG. 5, one (for right ear for example) of each pair of head related transfer functions is illustrated as an example. In FIG. 5, (a) illustrates a time waveform of a head related transfer function of 60°, (b) illustrates a time waveform of a head related transfer function of 90°, and (c) illustrates a time waveform of a head related transfer function of 120°.

As illustrated in (a) of FIG. 5, the time difference control unit 103 sets the phases (phase difference) such that the head related transfer function of 60° has a delay of N (N; N>0) msec, with respect to the head related transfer function of 90° for example.

As illustrated in (c) of FIG. 5, the time difference control unit 103 sets the phases (phase difference) such that the head related transfer function of 120° has a delay of N+M (M; M>0) msec, with respect to the head related transfer function of 90° for example.

It should be noted that, in FIG. 5, in the case where there is no delay between the head related transfer function of 60° and the head related transfer function of 120°, and there is a match with the head related transfer function of 90° (N=0), this case means that the listener 115 listens to sounds output by the respective head related transfer functions at the same time.

The amount of delay N is set to be a suitable value so that a virtual sound image by the head related transfer function of 90° and a virtual sound image by the head related transfer function of 60° are separately localized (the virtual sound images are perceived by the listener 115 after the localization). Likewise, the amount of delay N+M is set to be a suitable value so that a virtual sound image by the head related transfer function of 60° and a virtual sound image by the head related transfer function of 120° are separately localized (the virtual sound images are perceived by the listener 115 after the localization).

The suitable amounts of delay as described above are determined by, for example, performing subjective evaluation experiments in advance. First, each of the amount of delay between the head related transfer function of 90° and the head related transfer function of 60°, and the amount of delay between the head related transfer function of 60° and the head related transfer function of 120° are varied. Next, the amount of delay which produces a preceding sound effect is determined, specifically the amount of delay with which the virtual sound image in the direction of 90° is perceived firstly, the virtual sound image in the direction of 60° is perceived next, and the virtual sound image in the direction of 120° is perceived lastly.

It should be noted that, if the amount of delay is too large, not only the virtual sound images are separately localized in the respective directions of 60°, 90°, and 120°, but also echo effects are too much, producing a sound field in which the virtual sound images produce unnatural sounds. Accordingly, it is desirable that the amount of delay be not too large.

In the example of FIG. 5, the amount of delay is set so that the head related transfer function of 90° is perceived firstly due to a preceding sound effect. However, it is also possible to set the amount of delay so that another one of the head related transfer functions is perceived firstly due to a preceding sound effect.

Figure 6:
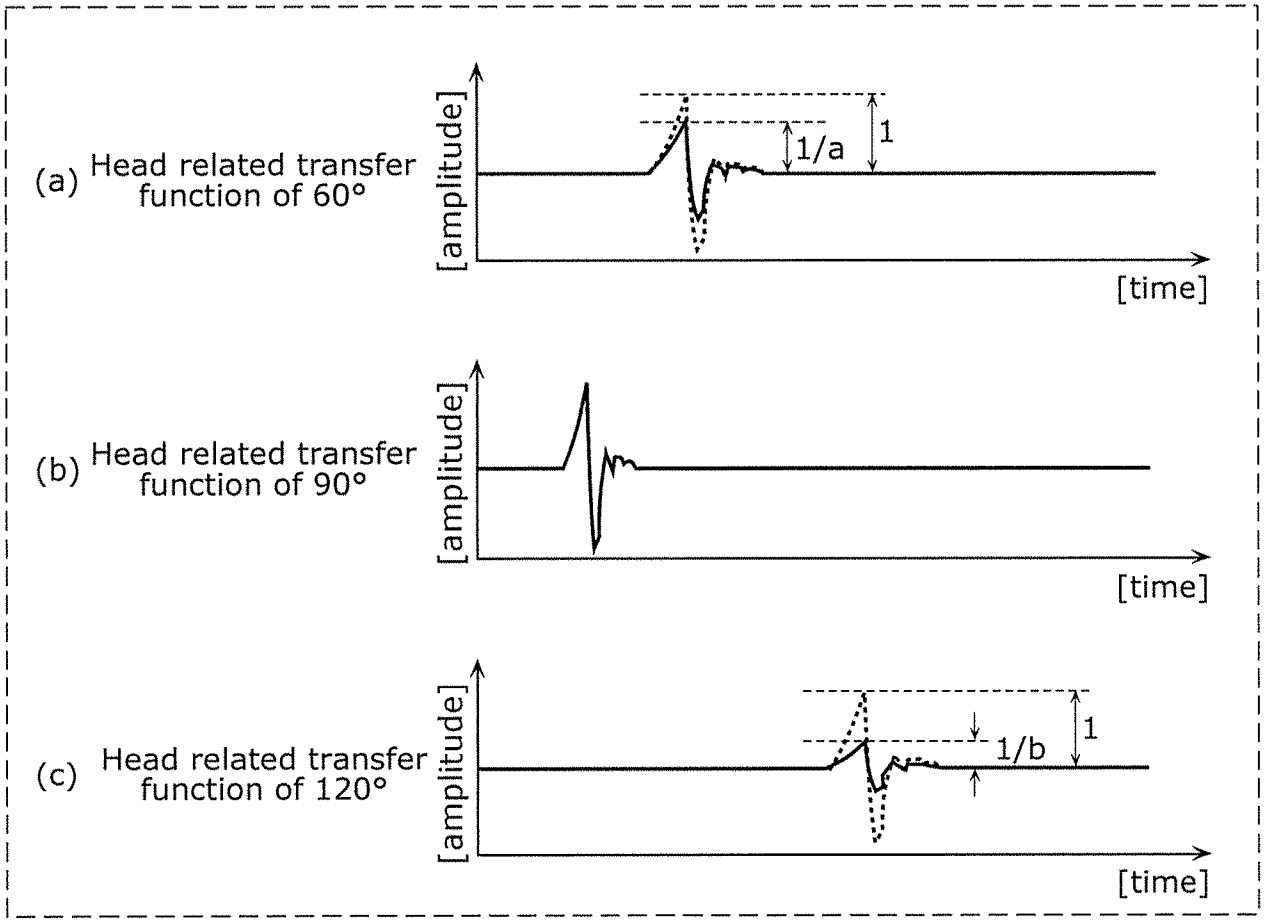
FIG. 6 is a diagram illustrating time waveforms of head related transfer functions for explaining methods for setting gains.

Next, methods performed by the gain adjusting unit 104 to set gains are explained. FIG. 6 is a diagram illustrating time waveforms of head related transfer functions for explaining methods for setting gains. FIG. 6 illustrates time waveforms of head related transfer functions of 60°, 90°, 120° having phases adjusted by the time difference control unit 103.

The gain adjusting unit 104 multiplies the head related transfer function of 90° played back firstly due to a preceding sound effect with a gain of 1 so as not to change the amplitude.

Meanwhile, the gain adjusting unit 104 sets the amplitude of the head related transfer function of 60° to 1/a, and the amplitude of the head related transfer function of 120° to 1/b.

Here, the 1/a denoting a scaling factor of an amplitude is set so that the virtual sound image by the head related transfer function of 90° and the virtual sound image by the head related transfer function of 60° are separately localized, and the listener 115 can perceive the sound images from the virtual speakers effectively. Here, the 1/b denoting a scaling factor of an amplitude is set so that the virtual sound image by the head related transfer function of 60° and the virtual sound image by the head related transfer function of 120° are separately localized, and the listener 115 can perceive the sound images from the virtual speakers effectively.

In order to determine suitable gains, for example, subjective evaluation experiments are performed in advance. First, the time differences (phase differences) are set so that the above-described preceding sound effects are obtained between the head related transfer function of 90° and the head related transfer function of 60°, and between the head related transfer function of 60° and the head related transfer function of 120°. Stated differently, the preceding sound effects for allowing the listener 115 to perceive the virtual sound image in the direction of 90° firstly, the virtual sound image in the direction of 60° next, and the virtual sound image in the direction of 120° lastly are firstly established. Subsequently, the gains of the respective head related transfer functions are changed to determine gains for allowing the listener 115 to aurally perceive the sound images from the virtual speakers effectively.

In order to generate a sound field in which preceding sound effects are clearly perceived around the listener 115, it is desirable that the amplitudes of the head related transfer functions in the directions other than the direction of 90° that is perceived firstly be −2 dB ($a \geq 1.25$, $b \geq 1.25$) or below with respect to the head related transfer function in the direction of 90°. However, depending on the sound field to be generated, amplitudes may be $a=1.0$ and $b=1.0$ or $a<1.0$ and $b<1.0$ without being reduced as explained above.

Figure 7A:
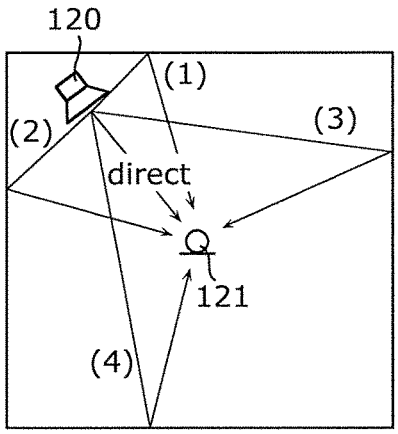
FIG. 7A is a diagram for explaining reverb components in a small space.
Figure 7B:
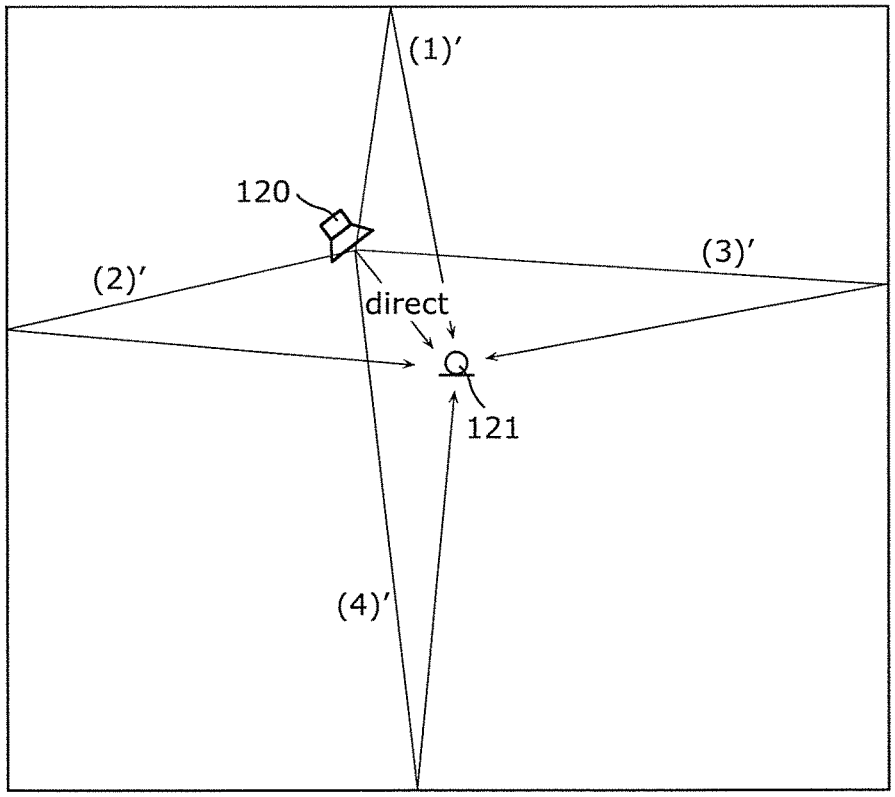
FIG. 7B is a diagram for explaining reverb components in a large space.

Next, methods performed by the reverb component adding unit 105 to add reverb components are explained. FIG. 7A and FIG. 7B are diagrams for explaining reverb components in different spaces.

Figure 8A:
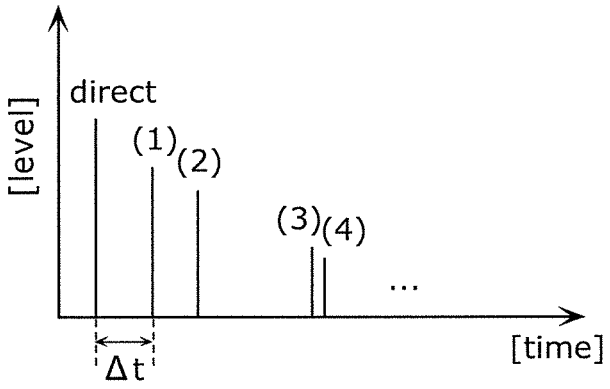
FIG. 8A is a diagram illustrating an impulse response of reverb components in the space in FIG. 7A.
Figure 8B:
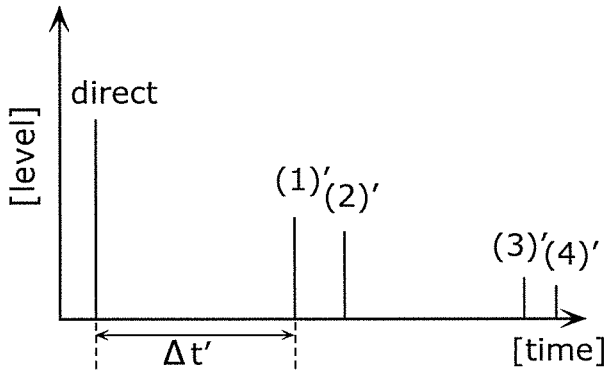
FIG. 8B is a diagram illustrating an impulse response of reverb components in the space in FIG. 7B.

Each of FIG. 7A and FIG. 7B illustrates how a measurement signal is played back from a speaker 120 disposed in a space (a small space in FIG. 7A or a large space in FIG. 7B), and how an impulse response of reverb components is measured by a microphone 121 disposed at the center. FIG. 8A is a diagram illustrating an impulse response of reverb components in the space in FIG. 7A, and FIG. 8B is a diagram illustrating an impulse response of reverb components in the space in FIG. 7B.

In the space illustrated in FIG. 7A, when the measurement signal is reproduced from the speaker 120 disposed in the space, a direct wave component ("direct" in the diagram) reaches the microphone 121 firstly, and reflected wave components (1) to (4) reach the microphone 121 sequentially. There are numerous reflected wave components other than those above, only the four reflected wave components are illustrated for simplification.

Likewise, in the space illustrated in FIG. 7B, when the measurement signal is reproduced from the speaker 120 disposed in the space, a direct wave component ("direct" in the diagram) reaches the microphone 121 firstly, and reflected wave components (1)' to (4)' reach the microphone 121 sequentially. The small space and the large space are different in the space sizes, the distances from the speakers to walls, and the distances from the walls to the microphone. Thus, the reflected wave components (1) to (4) reach earlier than the reflected wave components (1)' to (4)'. For this reason, the small space and the large space are different in the reverb components as in the impulse responses of the reverb components illustrated in FIGS. 8A and 8B.

Figure 9A:
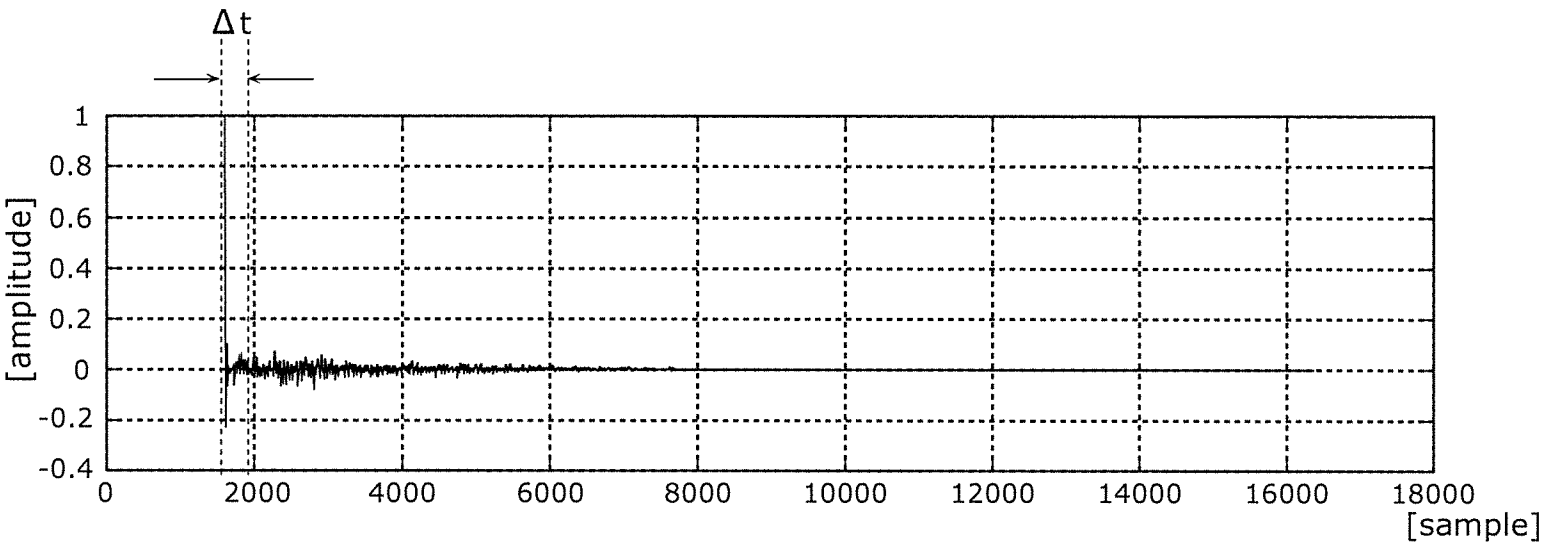
FIG. 9A is a diagram illustrating actually measured data of an impulse response of reverb components in a small space.

Next, actually measured data of such reverb components are described. FIG. 9A is a diagram illustrating actually measured data of the impulse response of the reverb components in the small space.

Figure 9B:
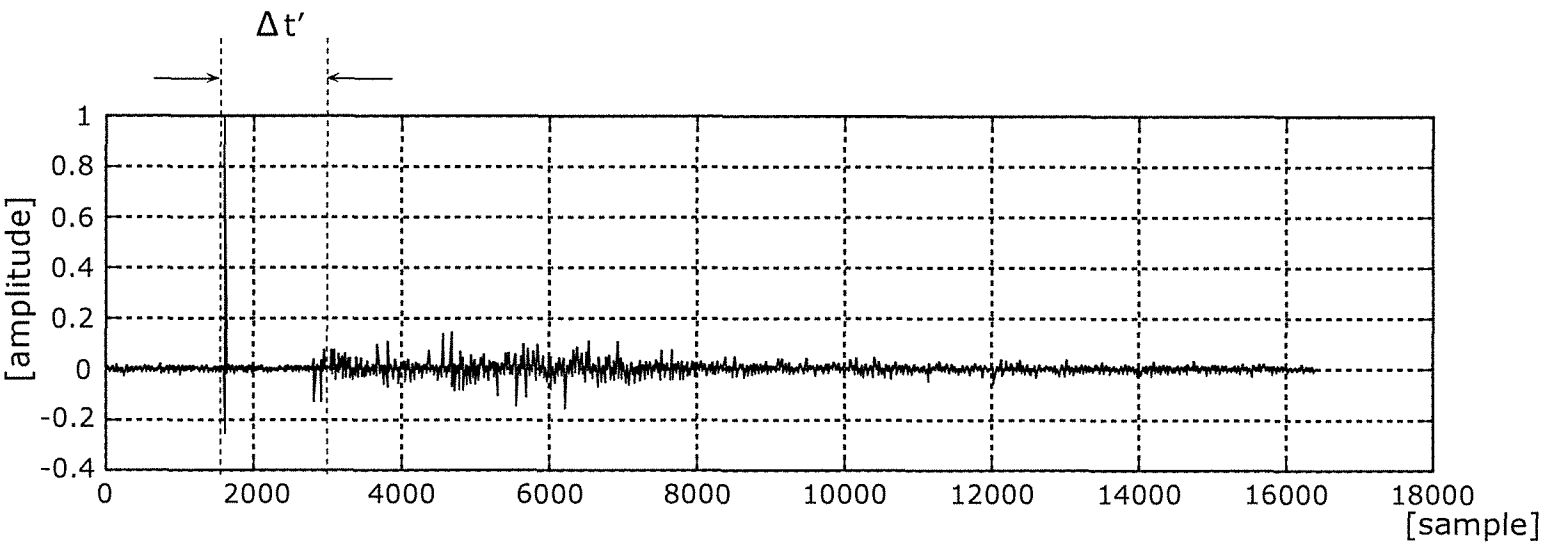
FIG. 9B is a diagram illustrating actually measured data of an impulse response of reverb components in a large space.

FIG. 9B is a diagram illustrating actually measured data of the impulse response of the reverb components in the large space. In each of the graphs in FIGS. 9A and 9B, the horizontal axis denotes the number of samples in the case where sampling is performed at a sampling frequency of 48 kHz.

Figure 10:
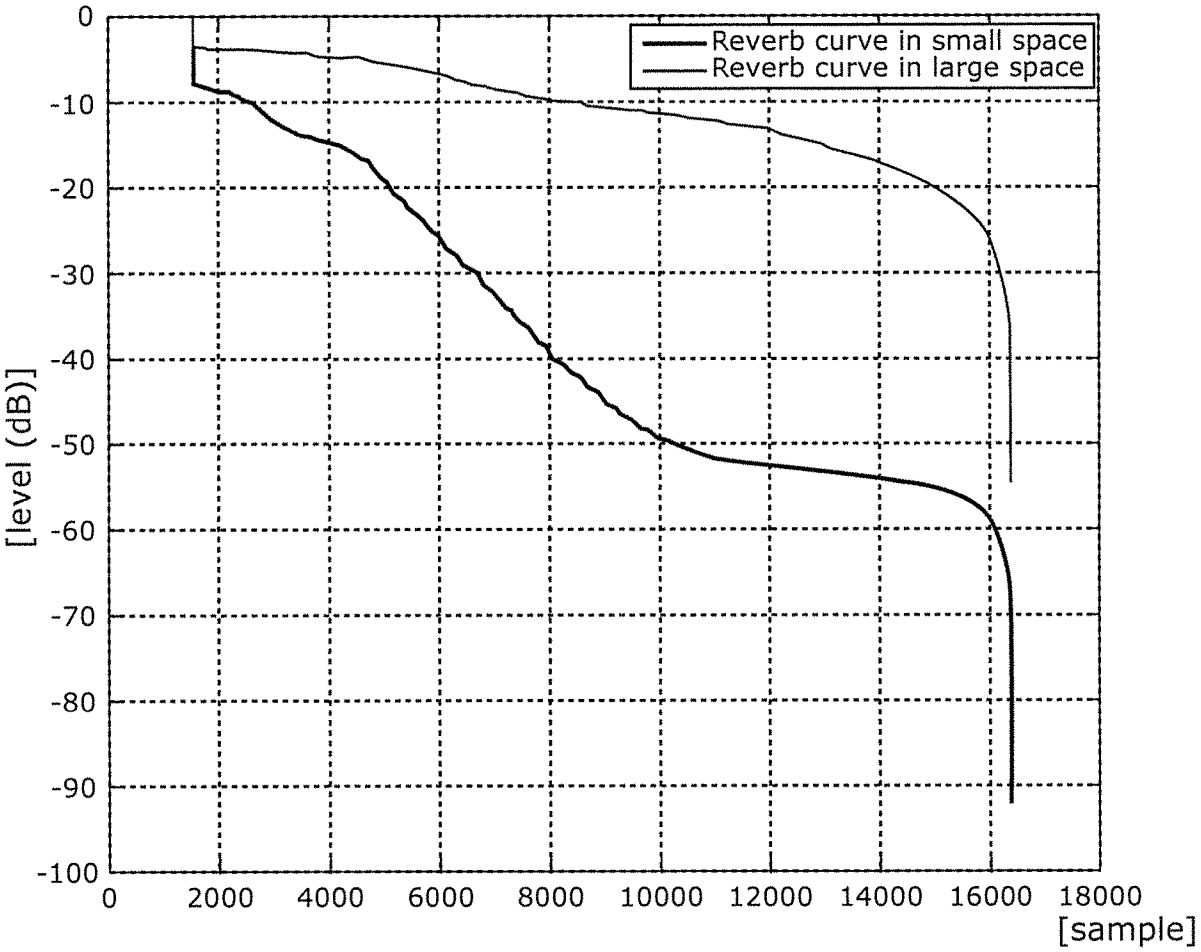
FIG. 10 is a diagram illustrating reverb curves of two impulse responses in FIGS. 9A and 9B.

The time difference between a direct wave component and an initial reflected component in the small space illustrated in FIG. 9A is defined as $\Delta t$, and the time difference between a direct wave component and an initial reflected component in the small space illustrated in FIG. 9B is defined as $\Delta t'$. FIG. 10 is a diagram illustrating reverb curves of two impulse responses in FIGS. 9A and 9B. In the graph in FIG. 10, the horizontal axis denotes the number of samples in the case where sampling is performed at a sampling frequency of 48 kHz.

From the graph in FIG. 10, it is possible to calculate the reverb time in each of the small space and the large space. Here, reverb time means time required for energy to attenuate to 60 dB.

In the small space, attenuation of 20 dB occurs between 5100-8000 samples. Thus, the reverb time in the small space is calculated as approximately 180 msec. Likewise, in the large space, attenuation of 3 dB occurs between 6000-8000 samples. Thus, the reverb time in the large space is calculated as approximately 850 msec. Here, in Embodiment 1, "reverb components in different spaces" are defined as satisfying at least Expression 1 below. Stated differently, when the reverb time in the small space is RT_small and the reverb time in the large space is RT_large, the reverb components in the different spaces satisfy Expression 1 below.

[Math.]

$$\Delta t' \geq \Delta t, \text{ and } RT_large \geq RT_small \quad \text{(Expression 1)}$$

Specific methods for adding the reverb components in the different spaces defined as described above to head related transfer functions are explained. The reverb component adding unit 105 firstly adds (convolves) the reverb components in the small space in which the number of reverb components is small to the head related transfer function of 90° perceived firstly due to a preceding sound effect. This produces a sound image having a comparatively small blur due to reverb components, thereby making it possible to generate virtual sound images that are clearly localized.

The reverb components in the large space have reflected sound components having energy larger than energy in the small space. The reverb components in the large space have reflected sound components having duration time larger than duration time in the small space.

Next, the reverb component adding unit 105 adds (convolves) the reverb components in the large space with many reverb components to each of the head related transfer function of 60° and the head related transfer function of 120°. This produces a sound image having a comparatively large blur due to reverb components, thereby making it possible to generate virtual sound images that are localized widely around the listener 115.

The head related transfer functions (pairs of head related transfer functions) adjusted as described above are convolved into the R signal and the L signal obtained by the obtaining unit 101 to generate the processed R signal and the processed L signal. The generated processed R signal is played back from the near-ear R speaker 119, and the generated processed L signal is played back from the near-ear L speaker 118. Accordingly, the listener 115 perceives the clear virtual sound image having a small blur in the direction of 90° earlier than the other sound images, and after a small time delay, perceives wide virtual sound images each having a large blur and in the directions of 60° and 120°. As a result, an unconventional wide surround sound field is generated around the listener 115. In short, the audio signal processing apparatus 10 is capable of providing higher surround effects by the virtual sound images.

The methods for adjusting the head related transfer functions as described above are non-limiting examples based on the Inventor's knowledge that "the virtual sound image in the direction of 90° that is a large interaural phase difference significantly affects surround effects provided to the listener 115". Thus, methods for adjusting the head related transfer functions are not specifically limited to the non-limiting examples.

For example, the processes performed by the time difference control unit 103, the gain adjusting unit 104, the reverb component adding unit 105 are not essential. In the case where a desired sound field is obtainable without performing these processes, these processes do not need to be performed.

In addition, all of the processes performed by the time difference control unit 103, the gain adjusting unit 104, and the reverb component adding unit 105 do not always need to be performed. The virtual sound field is adjusted by means of the control unit 100 performing at least one of (i) the process of adding different reverb components to pairs of head related transfer functions to be convolved into the R signal (or the L signal), (ii) the process of setting phase differences to the pairs, and (iii) the process of multiplying the pairs with different gains.

In addition, the processing order of the processes performed by the time difference control unit 103, the gain adjusting unit 104, and the reverb component adding unit 105 is not specifically limited. For example, the time difference control unit 103 does not always need to be at a stage that follows the head related transfer function setting unit 102, and may be at a stage that follows the gain adjusting unit 104. This is because, since the plurality of head related transfer functions for localizing the virtual sound images in a plurality of directions are independent, it is possible to obtain the same effects by also adjusting the time differences of the head related transfer functions after adjusting the gains individually.

Effects Etc.

As described above, in Embodiment 1, the audio signal processing apparatus 10 includes: the obtaining unit 101 which obtains the stereo signal including the R signal and the L signal; the control unit 100 which generates the processed R signal and the processed L signal by performing the first process and the second process; and the output unit 107 which outputs the processed R signal and the processed L signal.

Here, the first process is a process of convolving two or more pairs of right-ear head related transfer functions and left-ear head related transfer functions to the R signal in order to localize the sound image of the R signal at two or more different positions at the right side of the listener 115. Here, "the two or more different positions at the right side of the listener 115" are three positions of the position of the virtual front R speaker 110, the position of the virtual side R speaker 112, and the position of the virtual back R speaker 114.

In addition, the second process is a process of convolving two or more pairs of right-ear head related transfer functions and left-ear head related transfer functions to the L signal in order to localize the sound image of the L signal at each of two or more different positions at the left side of the listener 115. Here, "the two or more different positions at the left side of the listener 115" are three positions of the position of the virtual front L speaker 109, the position of the virtual side L speaker 111, and the position of the virtual back L speaker 113.

In this way, by convolving the plurality pairs of head related transfer functions to a single channel signal, for example, it is possible to allow the listener 115, when listening to the processed R signal and the processed L signal using a headphone, to perceive the signals as if the resulting sound is generated outside his or her head, thereby enjoying high surround effects. Accordingly, the listener 115 can enjoy high surround effects produced by the virtual sound images.

The control unit 100 may be configured to perform: the first process in which different reverb components are added to the two or more pairs of head related transfer functions to be convolved into the R signal, and the two or more pairs of head related transfer functions with the different reverb components are convolved into the R signal; and the second process in which different reverb components are added to the two or more pairs of head related transfer functions to be convolved into the L signal, and the two or more pairs of head related transfer functions with the different reverb components are convolved into the L signal.

More specifically, the control unit 100 may be configured to: add the different reverb components to the two or more pairs of head related transfer functions to be convolved into the R signal, the different reverb components being obtained through simulation in spaces, the spaces becoming larger as interaural time differences of the two or more pairs become smaller; and add the different reverb components to the two or more pairs of head related transfer functions to be convolved into the L signal, the different reverb components being obtained through simulation in spaces, the spaces becoming larger as interaural time differences of the two or more pairs become smaller.

By doing so, the listener 115 can perceive a sound having a large interaural time difference clearly, and a sound having a small interaural time difference with surround sensations.

The control unit 100 may further be configured to perform: the first process in which different reverb components are added to the two or more pairs of head related transfer functions to be convolved into the R signal, and the two or more pairs of head related transfer functions with the different reverb components are convolved into the R signal; and the second process in which different reverb components are added to the two or more pairs of head related transfer functions to be convolved into the L signal, and the two or more pairs of head related transfer functions with the different reverb components are convolved into the L signal.

By doing so, the listener 115 can listen to the sound from each of the localization positions of the virtual sound images with a time difference, thereby effectively perceiving the sound as if the sound is generated outside his or her head.

The control unit 100 may further be configured to: set a phase difference to each pair of the two or more pairs of head related transfer functions to be convolved into the R signal such that a phase of a latter head related transfer function of the pair is delayed more significantly as an interaural time difference of the pair becomes smaller; and set a phase difference to each pair of the two or more pairs of head related transfer functions to be convolved into the L signal such that a phase of a latter head related transfer function of the pair is delayed more significantly as an interaural time difference of the pair becomes smaller.

By doing so, the listener 115 can listen to the sound to be localized at the position with a larger interaural time difference earlier than the other sounds. The listener 115 strongly recognizes the sound reached earlier from the localization position with the larger interaural time difference, and thus can perceive the sound as if the sound is generated outside his or her head.

The control unit 100 may further be configured to perform the first process in which the two or more pairs of head related transfer functions to be convolved into the R signal are multiplied by different gains, and the two or more pairs of head related transfer functions multiplied by the different gains are convolved into the R signal; and perform the second process in which the two or more pairs of head related transfer functions to be convolved into the L signal are multiplied by different gains, and the two or more pairs of head related transfer functions multiplied by the different gains are convolved into the L signal.

By doing so, the listener 115 can listen to the sounds having different magnitudes from each of the localization positions of the virtual sound images with a time difference, thereby effectively perceiving the sounds as if the sounds are generated outside his or her head.

The control unit 100 may further be configured to: multiply each of the two or more pairs of head related transfer functions to be convolved into the R signal with a gain which becomes larger as an interaural time difference becomes larger; and multiply each of the two or more pairs of head related transfer functions to be convolved into the L signal with a gain which becomes larger as an interaural time difference becomes larger.

By doing so, it is possible to allow the listener 115 to listen to a larger sound as the interaural time difference is larger. The listener 115 strongly recognizes the sound reached from the localization position with the larger interaural time difference, and thus can perceive the sound as if the sound is generated outside his or her head.

The control unit 100 may further be configured to: perform the first process in which at least one of the following processes is performed: (i) a process of adding different reverb components to the two or more pairs of head related transfer functions to be convolved into the R signal; (ii) a process of setting phase differences to the two or more pairs of head related transfer functions; and (iii) a process of multiplying the two or more pairs of head related transfer functions by different gains, and a result of the at least one of the processes is convolved into the R signal; and perform the second process in which at least one of the following processes is performed: (i) a process of adding different reverb components to the two or more pairs of head related transfer functions to be convolved into the L signal; (ii) a process of setting phase differences to the two or more pairs of head related transfer functions; and (iii) a process of multiplying the two or more pairs of head related transfer functions by different gains, and a result of the at least one of the processes is convolved into the L signal.

It is to be noted that the control unit 100 may be configured to: generate a first R signal and a first L signal through the first process; generate a second R signal and a second L signal through the second process; generate the processed R signal by synthesizing the first R signal and the second R signal; and generate the processed L signal by synthesizing the first L signal and the second L signal.

More specifically, the two or more pairs of head related transfer functions to be convolved into the R signal may include (i) a pair of a first right-ear head related transfer function and a first left-ear head related transfer function for localizing a sound image of the R signal at a first position at the right side of the listener 115 and (ii) a pair of a second right-ear head related transfer function and a second left-ear head related transfer function for localizing a sound image of the R signal at a second position at the right side of the listener 115. Likewise, the two or more pairs of head related transfer functions to be convolved into the L signal may include (i) a pair of a third right-ear head related transfer function (for example, FL_R in FIG. 2B) and a third left-ear head related transfer function (for example, FL_L in FIG. 2B) for localizing a sound image of the L signal at a third position at the left side of the listener 115 and (ii) a pair of a fourth right-ear head related transfer function (for example, FL_R' in FIG. 2B) and a fourth left-ear head related transfer function (for example, FL_L' in FIG. 2B) for localizing a sound image of the L signal at a fourth position at the left side of the listener 115.

Subsequently, the control unit 100 may generate, through the first process, the first R signal obtained by convolving the first right-ear head related transfer function and the second right-ear head related transfer function into the R signal and the first L signal obtained by convolving the first left-ear head related transfer function and the second left-ear head related transfer function into the R signal. Likewise, the control unit 100 may generate, through the second process, the second R signal obtained by convolving the third right-ear head related transfer function and the fourth right-ear head related transfer function into the L signal and the second L signal obtained by convolving the third left-ear head related transfer function and the fourth left-ear head related transfer function into the L signal. The second R signal is, for example, a signal which is obtained by convolving the FL_R and FL_R' into the L signal and is output to the near-ear R speaker 119 in FIG. 2B, and the second L signal is, for example, a signal which is obtained by convolving the FL_L and FL_L' into the L signal and is output to the near-ear L speaker 118 in FIG. 2B.

The control unit 100 may further be configured to: convolve, in the first process, two or more pairs of first head related transfer functions into the R signal by convolving, into the R signal, a first synthesized head related transfer function obtained by synthesizing the two or more pairs of first head related transfer functions which are the two or more pairs of head related transfer functions to be convolved into the R signal; and convolve, in the second process, two or more pairs of second head related transfer functions into the L signal by convolving, into the L signal, a second synthesized head related transfer function obtained by synthesizing the two or more pairs of second head related transfer functions which are the two or more pairs of head related transfer functions to be convolved into the L signal.

Other Embodiments

Embodiment 1 has been described above as an example of the technique disclosed in the present application. However, the technique disclosed herein is not limited thereto, and is applicable to embodiments obtainable by performing modification, replacement, addition, omission, etc. as necessary. Furthermore, it is also possible to obtain a new embodiment by combining any of the constituent elements explained in Embodiment 1.

In view of this, some other embodiments are explained below.

Although the obtaining unit 101 obtains a stereo signal in Embodiment 1, the obtaining unit 101 may obtain a two-channel signal other than the stereo signal. Alternatively, the obtaining unit 101 may obtain a multi-channel signal having more channels than the two-channel signal. In this case, it is only necessary that a synthesized head related transfer function be generated for each channel signal. It is also good to process, as processing targets, only a part of channel signals among the multi-channel signals of two-channel or above.

Although the near-ear L speaker 118 and the near-ear R speaker 119 of the head phone or the like are used as examples in Embodiment 1, a normal L speaker and R speaker may be used.

It is to be noted that each of the constituent elements (for example, the constituent elements included in the control unit 100) in Embodiment 1 may be configured in the form of an exclusive hardware product, or may be realized by executing a software program suitable for the constituent element. Each of the constituent elements may be realized by means of a program executing unit, such as a CPU and a processor, reading and executing the software program recorded on a recording medium such as a hard disk or a semiconductor memory.

Each of the functional blocks illustrated in the block diagram of FIG. 1 is typically implemented as an LSI (such as a digital signal processor (DSP)) that is an integrated circuit. These functional blocks may be made as separate individual chips, or as a single chip to include a part or all thereof.

For example, the functional blocks other than a memory may be integrated into a single chip.

Although the LSI is mentioned above, there are instances where, due to a difference in the degree of integration, the designations IC, system LSI, super LSI, and ultra LSI may be used.

Furthermore, the means for circuit integration is not limited to the LSI, and implementation with a dedicated circuit or a general-purpose processor is also available. It is also possible to use a field programmable gate array (FPGA) that is programmable after the LSI has been manufactured, and a reconfigurable processor in which connections and settings of circuit cells within the LSI are reconfigurable.

Furthermore, if integrated circuit technology that replaces LSI appears through progress in semiconductor technology or other derived technology, that technology can naturally be used to carry out integration of the functional blocks. Application of biotechnology is one such possibility.

Furthermore, only the means for storing data to be coded or decoded among the functional blocks may be configured as a separate element without being integrated into the single chip.

The process executed by a particular processing unit may be executed by another processing unit in Embodiment 1. The processing order of the plurality of processes may be changed, or two or more of the processes may be executed in parallel.

It should be noted that any of the general and specific implementations disclosed here may be implemented as a system, a method, an integrated circuit, a computer program, or a computer-readable recording medium such as a CD-ROM. Any of the general and specific implementations disclosed here may be implemented by arbitrarily combining the system, the method, the integrated circuit, the computer program, and the recording medium. For example, the present disclosure may be implemented as an audio signal processing method.

Embodiment 1 has been described above as the example of the technique disclosed in the present application. For illustrative purposes only, the attached drawings and the detailed embodiments have been provided.

Accordingly, the constituent elements described in the attached drawings and the detailed embodiments includes elements inessential for solving problems but for illustrative purposes only, in addition to elements essential for solving problems. Accordingly, the fact that the inessential constituent elements are described in the attached drawings and the detailed embodiments should not be directly relied upon as a basis for regarding that the inessential constituent elements are essential.

Since the above embodiment is provided as an example for explaining the technique in the present disclosure, various kinds of modification, replacement, addition, omission, etc. can be performed within the scope of the claims and the equivalents thereof.

Although only the exemplary embodiment of the present disclosure has been described in detail above, those skilled in the art will readily appreciate that many modifications are possible in the exemplary embodiment without materially departing from the novel teachings and advantages of the present disclosure. Accordingly, all such modifications are intended to be included within the scope of the present disclosure.

The present disclosure is applicable to apparatuses each including a device for playing back an audio signal from one or more pairs of speakers, and particularly to surround systems, TVs, AV amplifiers, stereo component systems, mobile phones, portable audio devices, etc.

The invention claimed is:

1. An audio signal processing apparatus comprising:

a non-transitory memory storing a program; and a hardware processor configured to execute the program and cause the audio signal processing apparatus to operate as:

an obtaining unit configured to obtain a stereo signal including an R signal and an L signal;

a control unit configured to generate a processed R signal and a processed L signal by performing (i) a first process of convolving two or more pairs of head related transfer functions which are a right-ear head related transfer function and a left-ear head related transfer function into the R signal so that a sound image of the R signal is localized at each of two or more different positions at a right side of a listener; and (ii) a second process of convolving two or more pairs of head related transfer functions which are a right-ear head related transfer function and a left-ear head related transfer function into the L signal so that a sound image of the L signal is localized at each of two or more different positions at a left side of the listener; and an output unit configured to output the processed R signal and the processed L signal, wherein the control unit is configured to perform:

the first process in which different reverb components are added to the two or more pairs of head related transfer functions to be convolved into the R signal, and the two or more pairs of head related transfer functions with the different reverb components are convolved into the R signal;

the second process in which different reverb components are added to the two or more pairs of head related transfer functions to be convolved into the L signal, and the two or more pairs of head related transfer functions with the different reverb components are convolved into the L signal;

add the different reverb components to the two or more pairs of head related transfer functions to be convolved into the R signal, the different reverb components being obtained through simulation in spaces, the spaces becoming larger as interaural time differences of the two or more pairs become smaller; and add the different reverb components to the two or more pairs of head related transfer functions to be convolved into the L signal, the different reverb components being obtained through simulation in spaces, the spaces becoming larger as interaural time differences of the two or more pairs become smaller.

2. The audio signal processing apparatus according to claim 1, wherein the control unit is configured to:

perform the first process in which at least one of the following processes is performed: (i) a process of adding different reverb components to the two or more pairs of head related transfer functions to be convolved into the R signal; (ii) a process of setting phase differences to the two or more pairs of head related transfer functions; and (iii) a process of multiplying the two or more pairs of head related transfer functions by different gains, and a result of the at least one of the processes is convolved into the R signal; and perform the second process in which at least one of the following processes is performed: (i) a process of adding different reverb components to the two or more pairs of head related transfer functions to be convolved into the L signal; (ii) a process of setting phase differences to the two or more pairs of head related transfer functions; and (iii) a process of multiplying the two or more pairs of head related transfer functions by different gains, and a result of the at least one of the processes is convolved into the L signal.

3. The audio signal processing apparatus according to claim 1, wherein the control unit is configured to:

convolve, in the first process, two or more pairs of first head related transfer functions into the R signal by convolving, into the R signal, a first synthesized head related transfer function obtained by synthesizing the two or more pairs of first head related transfer functions which are the two or more pairs of head related transfer functions to be convolved into the R signal; and convolve, in the second process, two or more pairs of second head related transfer functions into the L signal by convolving, into the L signal, a second synthesized head related transfer function obtained by synthesizing the two or more pairs of second head related transfer functions which are the two or more pairs of head related transfer functions to be convolved into the L signal.

4. An audio signal processing apparatus comprising:

a non-transitory memory storing a program; and a hardware processor configured to execute the program and cause the audio signal processing apparatus to operate as:

an obtaining unit configured to obtain a stereo signal including an R signal and an L signal;

a control unit configured to generate a processed R signal and a processed L signal by performing (i) a first process of convolving two or more pairs of head related transfer functions which are a right-ear head related transfer function and a left-ear head related transfer function into the R signal so that a sound image of the R signal is localized at each of two or more different positions at a right side of a listener; and (ii) a second process of convolving two or more pairs of head related transfer functions which are a right-ear head related transfer function and a left-ear head related transfer function into the L signal so that a sound image of the L signal is localized at each of two or more different positions at a left side of the listener; and an output unit configured to output the processed R signal and the processed L signal wherein the control unit is configured to:

perform the first process in which phase differences are set for the two or more pairs of head related transfer functions to be convolved into the R signal, and the two or more pairs of head related transfer functions having the phase differences are convolved into the R signal; and perform the second process in which phase differences are set for the two or more pairs of head related transfer functions to be convolved into the L signal, and the two or more pairs of head related transfer functions having the phase differences are convolved into the L signal;

set a phase difference to each pair of the two or more pairs of head related transfer functions to be convolved into the R signal such that a phase of a latter head related transfer function of the pair is delayed more significantly as an interaural time difference of the pair becomes smaller; and set a phase difference to each pair of the two or more pairs of head related transfer functions to be convolved into the L signal such that a phase of a latter head related transfer function of the pair is delayed more significantly as an interaural time difference of the pair becomes smaller.

5. An audio signal processing apparatus comprising:

a non-transitory memory storing a program; and a hardware processor configured to execute the program and cause the audio signal processing apparatus to operate as:

an obtaining unit configured to obtain a stereo signal including an R signal and an L signal;

a control unit configured to generate a processed R signal and a processed L signal by performing (i) a first process of convolving two or more pairs of head related transfer functions which are a right-ear head related transfer function and a left-ear head related transfer function into the R signal so that a sound image of the R signal is localized at each of two or more different positions at a right side of a listener; and (ii) a second process of convolving two or more pairs of head related transfer functions which are a right-ear head related transfer function and a left-ear head related transfer function into the L signal so that a sound image of the L signal is localized at each of two or more different positions at a left side of the listener; and an output unit configured to output the processed R signal and the processed L signal, wherein the control unit is configured to:

generate a first R signal and a first L signal through the first process;

generate a second R signal and a second L signal through the second process;

generate the processed R signal by synthesizing the first R signal and the second R signal; and generate the processed L signal by synthesizing the first L signal and the second L signal, and wherein the two or more pairs of head related transfer functions to be convolved into the R signal include (i) a pair of a first right-ear head related transfer function and a first left-ear head related transfer function for localizing a sound image of the R signal at a first position at the right side of the listener and (ii) a pair of a second right-ear head related transfer function and a second left-ear head related transfer function for localizing a sound image of the R signal at a second position at the right side of the listener, the two or more pairs of head related transfer functions to be convolved into the L signal include (i) a pair of a third right-ear head related transfer function and a third left-ear head related transfer function for localizing a sound image of the L signal at a third position at the left side of the listener and (ii) a pair of a fourth right-ear head related transfer function and a fourth left-ear head related transfer function for localizing a sound image of the L signal at a fourth position at the left side of the listener, and the control unit is further configured to:

generate, through the first process, the first R signal obtained by convolving the first right-ear head related transfer function and the second right-ear head related transfer function into the R signal and the first L signal obtained by convolving the first left-ear head related transfer function and the second left-ear head related transfer function into the R signal;

generate, through the second process, the second R signal obtained by convolving the third right-ear head related transfer function and the fourth right-ear head related transfer function into the L signal and the second L signal obtained by convolving the third left-ear head related transfer function and the fourth left-ear head related transfer function into the L signal.

6. An audio signal processing method comprising:

obtaining a stereo signal including an R signal and an L signal;

generating a processed R signal and a processed L signal by performing (i) a first process of convolving two or more pairs of head related transfer functions which are a right-ear head related transfer function and a left-ear head related transfer function into the R signal so that a sound image of the R signal is localized at each of two or more different positions at a right side of a listener; and (ii) a second process of convolving two or more pairs of head related transfer functions which are a right-ear head related transfer function and a left-ear head related transfer function into the L signal so that a sound image of the L signal is localized at each of two or more different positions at a left side of the listener; and outputting the processed R signal and the processed L signal, wherein in the first process different reverb components are added to the two or more pairs of head related transfer functions to be convolved into the R signal, and the two or more pairs of head related transfer functions with the different reverb components are convolved into the R signal; and in the second process different reverb components are added to the two or more pairs of head related transfer functions to be convolved into the L signal, and the two or more pairs of head related transfer functions with the different reverb components are convolved into the L signal, and wherein the audio signal processing method further comprises:

adding the different reverb components to the two or more pairs of head related transfer functions to be convolved into the R signal, the different reverb components being obtained through simulation in spaces, the spaces becoming larger as interaural time differences of the two or more pairs become smaller; and adding the different reverb components to the two or more pairs of head related transfer functions to be convolved into the L signal, the different reverb components being obtained through simulation in spaces, the spaces becoming larger as interaural time differences of the two or more pairs become smaller.

* * * * *